US010750273B2

(12) United States Patent
Uchida et al.

(10) Patent No.: US 10,750,273 B2
(45) Date of Patent: Aug. 18, 2020

(54) BASS REFLEX PORT AND BASS REFLEX TYPE SPEAKER

(71) Applicant: Yamaha Corporation, Hamamatsu-shi, Shizuoka-ken (JP)

(72) Inventors: Katsuya Uchida, Iwata (JP); Akira Miki, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/234,700

(22) Filed: Dec. 28, 2018

(65) Prior Publication Data

US 2019/0297413 A1 Sep. 26, 2019

(30) Foreign Application Priority Data

Mar. 23, 2018 (JP) ..... 2018-057203

(51) Int. Cl.
*H04R 1/28* (2006.01)
*H04R 1/02* (2006.01)
*H04R 1/34* (2006.01)

(52) U.S. Cl.
CPC ..... *H04R 1/2826* (2013.01); *H04R 1/025* (2013.01); *H04R 1/2815* (2013.01); *H04R 1/345* (2013.01)

(58) Field of Classification Search
CPC ..... H04R 1/2815; H04R 1/02; H04R 1/2823; H04R 1/2846; H04R 1/2838; H04R 1/2826; H04R 1/025; H04R 1/026
See application file for complete search history.

(56) References Cited

U.S. PATENT DOCUMENTS 5,517,573 A * 5/1996 Polk ..... H04R 1/2826 181/156
5,714,721 A * 2/1998 Gawronski ..... H04R 1/227 181/145
5,809,154 A * 9/1998 Polk ..... H04R 1/2826 181/156
7,162,049 B2 * 1/2007 Polk, Jr. ..... H04R 1/2826 181/156

(Continued)

FOREIGN PATENT DOCUMENTS

JP 2-279097 A 11/1990
JP 2014-183341 A 9/2014
JP 2016-27730 A 2/2016

OTHER PUBLICATIONS

Extended European Search Report issued in counterpart European Application No. 18214561.5 dated Jul. 24, 2019 (nine pages).

(Continued)

*Primary Examiner* — Fan S Tsang
*Assistant Examiner* — Angelica M McKinney
(74) *Attorney, Agent, or Firm* — Crowell & Moring LLP

(57) ABSTRACT

A bass reflex port including: a tubular body portion; and a surface forming portion which is board-like, and continuous to an inner wall of the tubular body portion and which has a surface extending radially outwardly from an opening end of the tubular body portion disposed in a housing of a speaker, wherein the surface forming portion extends linearly in a direction away from a tube axis of the tubular body portion in a cross section parallel to the tube axis.

8 Claims, 10 Drawing Sheets

(56) References Cited

U.S. PATENT DOCUMENTS

| | | | | |
|---|---|---|---|---|
| 8,391,528 | B2 * | 3/2013 | Vercelli | H04R 1/2826 181/156 |
| 9,854,353 | B2 * | 12/2017 | Wang | H04R 1/345 |
| 2009/0260915 | A1 * | 10/2009 | Arai | H04R 1/2826 181/156 |
| 2013/0333975 | A1 | 12/2013 | Dodd | |
| 2014/0262598 | A1 * | 9/2014 | Miki | H04R 1/2815 181/156 |
| 2018/0063633 | A1 * | 3/2018 | Muramatsu | H04R 1/2826 |

OTHER PUBLICATIONS

Chinese-language Office Action issued in Chinese Application No. 201910011921.0 dated Mar. 2, 2020 with English translation (19 pages).

* cited by examiner

BASS REFLEX PORT AND BASS REFLEX TYPE SPEAKER

CROSS REFERENCE TO RELATED APPLICATION

The present application claims priority from Japanese Patent Application No. 2018-057203, which was filed on Mar. 23, 2018, the disclosure of which is herein incorporated by reference in its entirety.

BACKGROUND

Technical Field

The following disclosure relates to a bass reflex port and a bass reflex type speaker.

Description of Related Art

A bass reflex type speaker is mainly applied to a subwoofer. Recently, there is desired a subwoofer capable of providing high output. However, when the output of the subwoofer is increased, a flow rate of the air that flows inside and outside a housing via a bass reflex port is increased, so that extraneous (or abnormal) noise is easily generated. Therefore, measures for reducing generation of extraneous noise have been required. There is conventionally proposed a measure for reducing generation of extraneous noise in which an end portion of a bass reflex port has a flare shape. For instance, Japanese Patent Application Publication No. 2016-27730 discloses such a measure.

SUMMARY

The technique described above has some effects of reducing extraneous noise. However, there still remains a problem that extraneous noise is generated from the bass reflex port when levels of input signals supplied to a speaker unit are increased, even where end portions of the bass reflex port near opposite ends thereof are formed to have a flare shape.

Accordingly, an aspect of the disclosure is directed to a technique of reducing extraneous noise generated from a bass reflex port, even where levels of input signals are high.

In one aspect of the disclosure, a bass reflex port includes: a tubular body portion; and a surface forming portion which is board-like, and continuous to an inner wall of the tubular body portion and which has a surface extending radially outwardly from an opening end of the tubular body portion disposed in a housing of a speaker, wherein the surface forming portion extends linearly in a direction away from a tube axis of the tubular body portion in a cross section parallel to the tube axis.

In another aspect of the disclosure, a bass reflex type speaker including a bass reflex port includes: a housing of the speaker; a tubular body portion; and a surface forming portion which is board-like, and continuous to an inner wall of the tubular body portion and which has a surface extending radially outwardly from an opening end of the tubular body portion disposed in the housing of the speaker, wherein the surface forming portion extends linearly in a direction away from a tube axis of the tubular body portion in a cross section parallel to the tube axis.

In the bass reflex port constructed as described above, the air that flows between a space inside the housing of the speaker and a space outside thereof is guided by the inner wall of the tubular body portion and the surface of the surface forming portion, so that separation of the air flow is not likely to occur in the vicinity of the opening end of the tubular body portion disposed in the housing. Accordingly, it is possible to decrease air turbulence in the bass reflex port and accordingly reduce extraneous noise.

BRIEF DESCRIPTION OF DRAWINGS

The above and other objects, features, advantages and technical and industrial significance of the disclosure will be better understood by reading the following detailed description of embodiments of the disclosure, when considered in connection with the accompanying drawings, in which.

DETAILED DESCRIPTION OF THE EMBODIMENTS

There will be hereinafter explained embodiments of the disclosure with reference to the drawings.

First Embodiment

Figure 1:
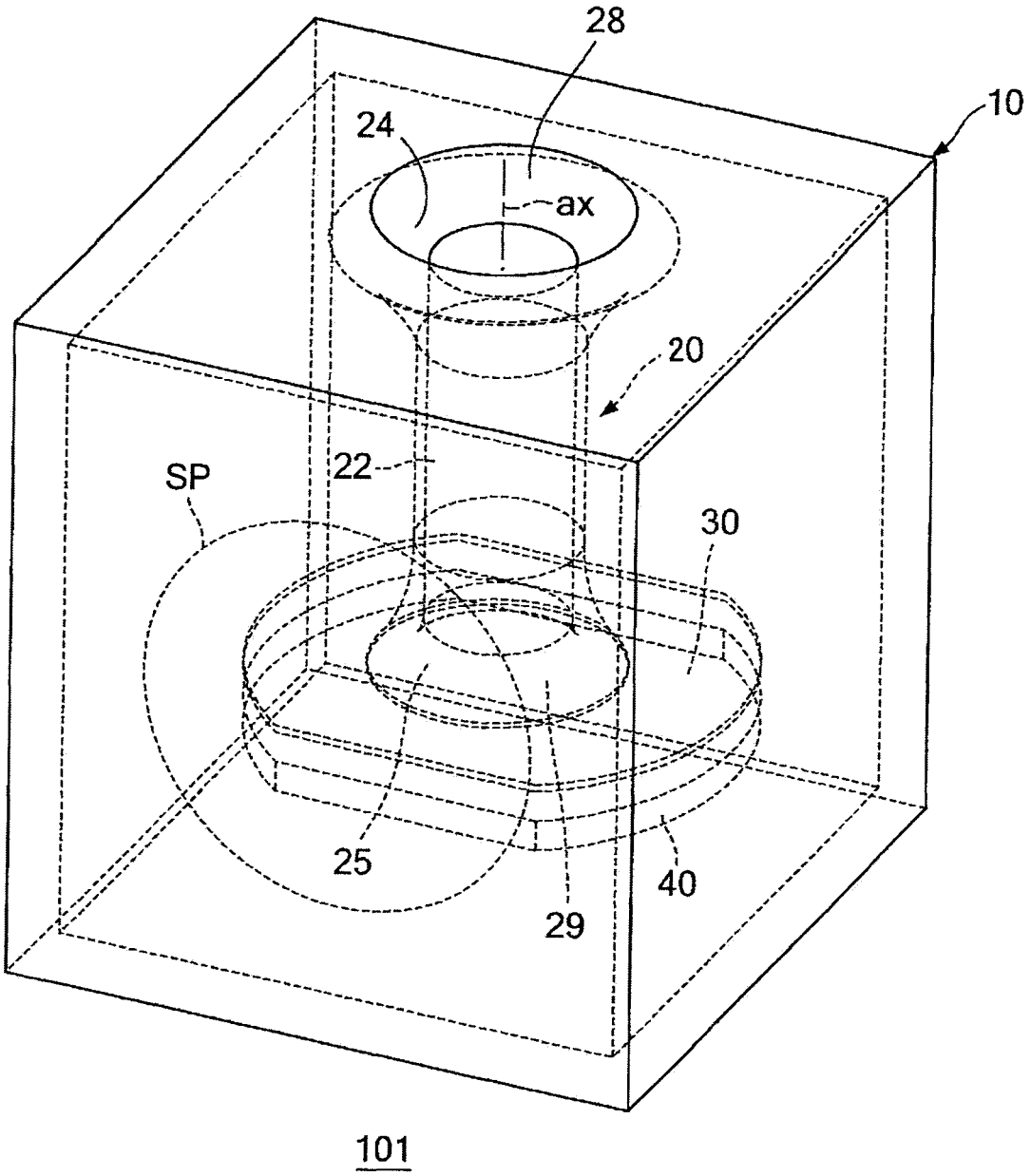
FIG. 1 is a perspective view of a bass reflex type speaker according to a first embodiment, the view seen from an obliquely upper side.
Figure 2:
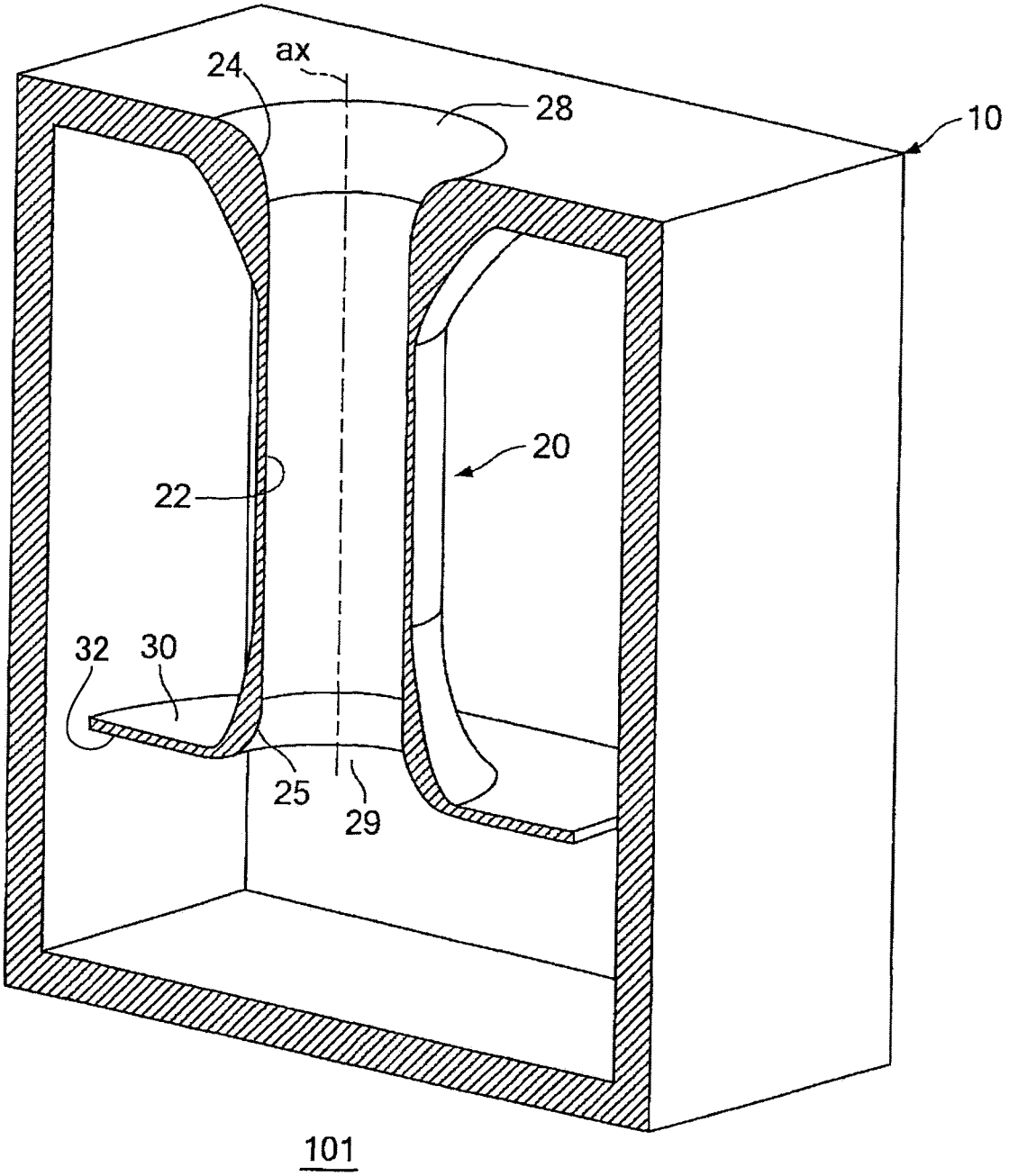
FIG. 2 is a cross-sectional view of a first structure of the bass reflex type speaker when the bass reflex type speaker is cut on a plane including a center axis of a bass reflex port and parallel to a surface of a housing on which a speaker unit is disposed.
Figure 3:
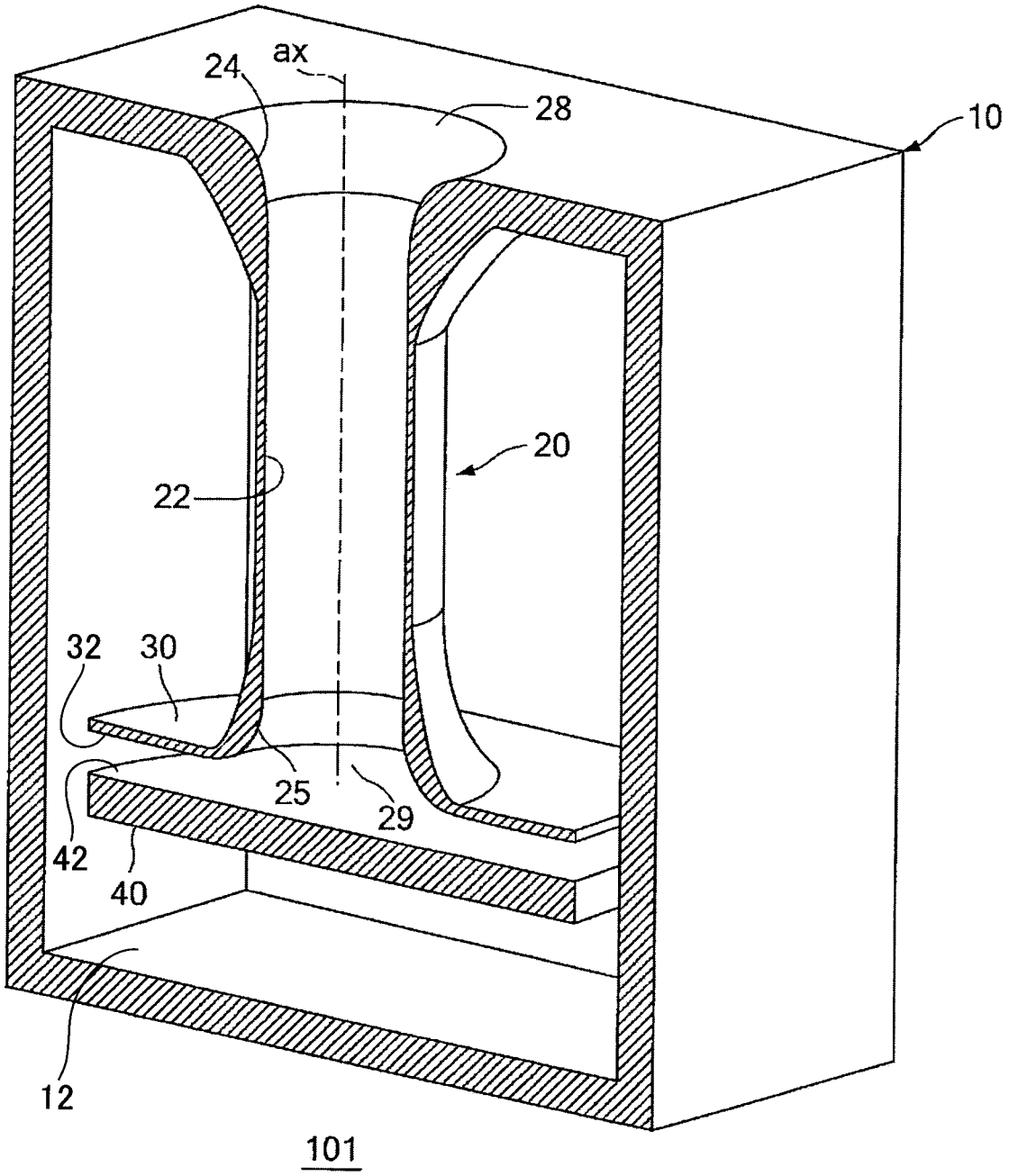
FIG. 3 is a cross-sectional view of a second structure of the bass reflex type speaker when the bass reflex type speaker is cut on the plane including the center axis of the bass reflex port and parallel to the surface of the housing on which the speaker unit is disposed.
Figure 4:
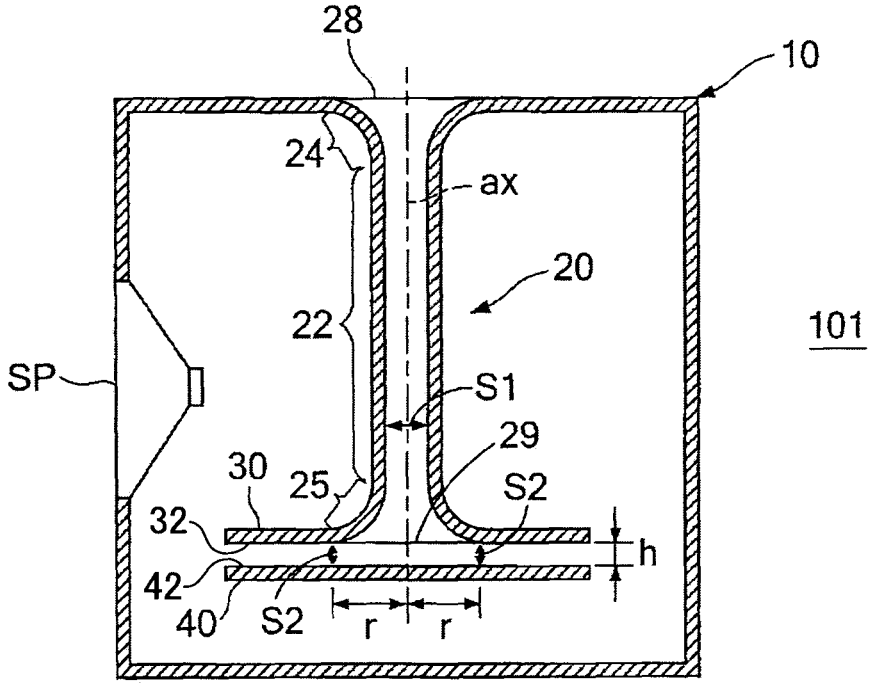
FIG. 4 is a cross-sectional front view schematically showing a cross-sectional structure of the bass reflex type speaker.

FIG. 1 is a perspective view of a bass reflex type speaker 101, seen from an obliquely upper side, according to a first embodiment of the disclosure. FIG. 2 is a cross-sectional view of a first structure of the bass reflex type speaker 101 when the bass reflex type speaker 101 is cut on a plane including a center axis ax (as one example of a tube axis) of a bass reflex port 20 (as one example of a tubular body portion) and parallel to a surface of a housing 10 on which a speaker unit SP is disposed. FIG. 3 is a cross-sectional view of a second structure of the bass reflex type speaker 101 when the bass reflex type speaker 101 is cut on the plane including the center axis ax of the bass reflex port 20 and parallel to the surface of the housing 10 on which the speaker unit SP is disposed. FIG. 4 is a cross-sectional front view schematically showing a cross-sectional structure of the bass reflex type speaker 101. FIG. 4 illustrates the bass reflex type speaker 101 in a cross section parallel to the center axis of the bass reflex port 20. In the first structure of the bass reflex type speaker 101 shown in FIG. 2, there is employed a first measure for preventing extraneous noise from being generated. Further, in the second structure of the bass reflex type speaker 101 shown in FIG. 3, there is employed a second measure for preventing generation of extraneous noise, in addition to the first measure. FIGS. 1 and 4 correspond to the second structure of the bass reflex type speaker 101. As shown in FIGS. 1-4, the bass reflex type speaker 101 has the housing 10, the speaker unit SP, the bass reflex port (the tubular body portion) 20, and a guiding portion 30 (as one example of a surface forming portion, a first surface forming portion, and an inside housing first surface forming portion).

The housing 10 is a rectangular parallelepiped constituted by six panels. In one of the six panels of the housing 10, namely, in a front panel that functions as a baffle panel, the speaker unit SP is disposed.

The bass reflex port 20 is a hollow tubular body portion having a substantially cylindrical shape. The bass reflex port 20 is sectioned into: a straight portion 22 whose cross-sectional area (i.e., an area of a cross section of a space enclosed with an inner wall of the bass reflex port 20 in a direction perpendicular to the center axis ax) is constant in a direction in which the center axis ax extends; and flare portions 24, 25 that function as inlets and outlets (openings) of the air at opposite ends of the straight portion 22. The flare portion 24 has a shape whose cross-sectional area gradually increases from the proximity of a boundary between the straight portion 22 and the flare portion 24 toward an opening end 28. The opening end 28 of the flare portion 24 is located at an upper surface of the housing 10 and forms an opening portion on the upper surface of the housing 10. The flare portion 25 has a flare shape whose cross-sectional area gradually increases from the proximity of a boundary between the straight portion 22 and the flare portion 25 toward an opening end 29. The opening end 29 of the flare portion 25 is located inside the housing 10. The opening end 29 is the inlet and outlet of the bass reflex port 20 inside the housing 10.

The present embodiment adopts the first structure shown in FIG. 2 as the first measure for preventing generation of extraneous noise. In other words, in the present embodiment, as shown in FIG. 2, the opening end 29 as the inlet and outlet of the bass reflex port 20 in an inside of the housing 10 is connected to the guiding portion 30, and the opening end 29 defines an opening portion of the guiding portion 30. The guiding portion 30 is continuous to an inner wall of the bass reflex port 20 and has an inner wall surface 32 (as one example of a surface extending radially outwardly from the opening end 29 and an inside housing first surface) which extends radially outwardly from the opening end 29 as the inlet and outlet of the bass reflex port 20 in the housing 10. As shown in FIG. 4, the guiding portion 30 extends linearly in a direction away from the center axis ax. Further, the inner wall surface 32 of the guiding portion 30 is orthogonal to the center axis ax of the bass reflex port 20. "Being orthogonal" includes that an angle defined by the inner wall surface 32 of the guiding portion 30 and the center axis ax of the bass reflex port 20 is substantially 90 degrees and includes, for example, a range of variations in production of the guiding portion 30. That is, it can be said that the inner wall surface 32 of the guiding portion 30 is substantially orthogonal to the center axis ax of the bass reflex port 20.

Furthermore, in the present embodiment, in addition to the above first measure, the second structure is adopted for the purpose of taking the second measure for preventing generation of extraneous noise. In the present embodiment, as shown in FIGS. 3 and 4, a wall 40 (as one example of an inside housing second surface forming portion) is supported in the inside of the housing 10. The wall 40 is opposed to the inner wall surface 32 of the guide portion 30 so as to be spaced apart from the inner wall surface 32 by a predetermined distance h. An opposed surface 42 (as one example of an inside housing second surface) of the wall 40 that is opposed to the inner wall surface 32 and the inner wall surface 32 of the guiding portion 30 are parallel to each other. In the present embodiment, as shown in FIGS. 3 and 4, the opposed surface 42 of the wall 40 and the inner wall surface 32 of the guiding portion 30 are parallel to a lower surface 12 (as one example of a bottom surface) of the housing 10. The opposed surface 42 and the inner wall surface 32 need not necessarily be parallel to the lower surface 12. The wall 40 is fixed to an inner wall (side surface) of the housing 10 by a connecting rod (not shown), for instance. The wall 40 is a wall except walls and a bottom that constitute an outline of the housing 10, and the wall 40 does not constitute the outline of the housing 10. The opposed surface 42 is a surface except respective surfaces of the walls and a surface of the bottom that constitute the outline of the housing 10.

In the structure shown in FIGS. 1-4, the air flow guided by the inner wall of the bass reflex port 20 flows out of an air-flow passage in the bass reflex port 20, and then the air flow is guided by the inner wall surface 32 of the guiding portion 30, so that the air flow is hard to be separated. This is an effect by the first measure. Further, the air flow guided by the inner wall of the bass reflex port 20 flows out of the air-flow passage in the bass reflex port 20, and then flows radially in a space between the inner wall surface 32 of the guiding portion 30 and the opposed surface 42 of the wall 40. Accordingly, a rapid change in a cross-sectional area of the air flow is suppressed, and separation of the air flow is not likely to occur. This is an effect by the second measure.

In the present embodiment, the distance h between the inner wall surface 32 of the guiding portion 30 and the opposed surface 42 of the wall 40 is determined so as not to cause a discontinuous change in a cross-sectional area of the air-flow passage. Specifically, the distance h is determined as follows. In an instance where the distance between the inner wall surface 32 of the guiding portion 30 and the opposed surface 42 of the wall 40 is defined as h and a distance from the center axis ax of the bass reflex port 20 to a cross section of the air flow is defined as r, a cross-sectional area S2 (as one example of a cross-sectional area of an air-flow passage between an inside housing first surface and an inside housing second surface at the opening end 29 of a flare portion) of the air flow that radially moves in the space between the inner wall surface 32 of the guiding portion 30 and the opposed surface 42 of the wall 40 is $2\pi rh$, i.e., $S2=2\pi rh$, which means that the cross-sectional area S2 becomes greater in proportion to the distance r from the center axis ax of the bass reflex port 20 to the cross section of the air flow. In an instance where the opening end 29 has a circular shape with a radius r0 (as one example of an instance where a cross section of an air-flow passage in a direction perpendicular to a tube axis of a tubular body portion has a circular shape with a radius r0), the distance h between the inner wall surface 32 of the guiding portion 30 and the opposed surface 42 of the wall 40 is determined to be r0/2. By thus determining the distance h, a cross-sectional area S (as one example of a perpendicular cross-sectional area of an air-flow passage at the opening end 29 of the flare portion 25, in a direction perpendicular to a tube axis) of an air-flow passage in the flare portion 25 at the opening end 29 is $\pi r0^2$, and the cross-sectional area S2 of the air-flow passage between the inner wall surface 32 of the guiding portion 30 and the opposed surface 42 of the wall 40 at the opening end 29 is $2\pi r0h=2\pi r0(r0/2)=\pi r0^2$. Thus, the cross-sectional area S2 and the cross-sectional area S are equal to each other. Accordingly, when the air flow moves from the bass reflex port 20 to the air-flow passage between the inner wall surface 32 of the guiding portion 30 and the opposed surface 42 of the wall 40, there is not caused a discontinuous change in the cross-sectional areas of the air-flow passages. Depending upon various conditions such as a shape of the flare portion 25 and so forth, the cross-sectional area S2 of the air-flow passage between the inner wall surface 32 of the guiding portion 30 and the opposed surface 42 of the wall 40 at the opening end 29 may coincide with a cross-sectional area S1 of an air-flow passage inside the straight portion 22 (as one example of a perpendicular cross-sectional area of an air-flow passage in a straight portion in a direction perpendicular to a tube axis), instead of the cross-sectional area S of the air-flow passage inside the flare portion 25 at the opening end 29. Alternatively, the cross-sectional area S2 of the air-flow passage between the inner wall surface 32 of the guiding portion 30 and the opposed surface 42 of the wall 40 at the opening end 29 may coincide with the cross-sectional area S of the air-flow passage in the flare portion 25 at a position near the opening end 29. It is idealistically preferable to determine the cross-sectional area S2 of the air-flow passage between the inner wall surface 32 of the guiding portion 30 and the opposed surface 42 of the wall 40 at the opening end 29 as described above. As long as there is maintained such a relationship that discontinuity in the cross-sectional area of the air-flow passage is relatively small, it is possible to prevent generation of extraneous noise. Specifically, generation of extraneous noise is effectively prevented by setting the cross-sectional area S2 of the air-flow passage between the inner wall surface 32 of the guiding portion 30 and the opposed surface 42 of the wall 40 at the opening end 29 so as to fall within a range from about one time the cross-sectional area S1 of the air-flow passage in the straight portion 22 to about 2.5 times the cross-sectional area S of the air-flow passage in the flare portion 25 at the opening end 29.

Figure 5A:
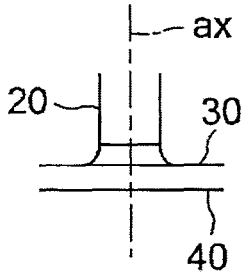
FIGS. 5A and 5B are views of a first example of respective planar shapes of a guiding portion and a wall of the bass reflex type speaker.
Figure 5B:
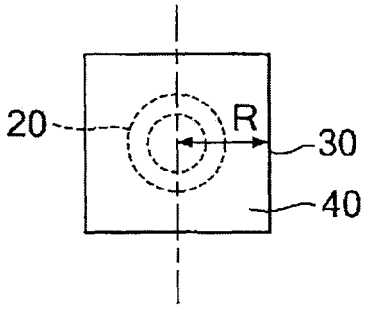
Figure 6A:
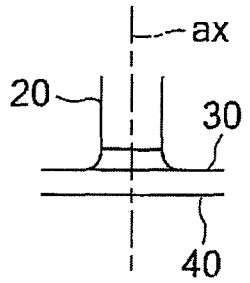
FIGS. 6A and 6B are views of a second example of respective planar shapes of a guiding portion and a wall of the bass reflex type speaker.
Figure 6B:
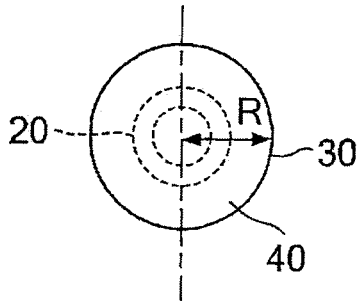

Respective planar shapes of the inner wall surface 32 of the guiding portion 30 and the opposed surface 42 of the wall 40 may be any arbitrary ones. FIGS. 5A and 5B are views showing a first example of respective planar shapes of the inner wall surface 32 of the guiding portion 30 and the opposed surface 42 of the wall 40, and FIGS. 6A and 6B are views showing a second example of respective planar shapes of the inner wall surface 32 of the guiding portion 30 and the opposed surface 42 of the wall 40. Each of FIGS. 5A and 6A shows the bass reflex port 20, guiding portion 30 and the wall 40 as viewed from a left or a right side, and each of FIGS. 5B and 6B shows the bass reflex port 20, guiding portion 30 and the wall 40 as viewed from a bottom surface of the housing 10.

In the first example shown in FIGS. 5A and 5B, each of the inner wall surface 32 of the guiding portion 30 and the opposed surface 42 of the wall 40 has a square shape with the identical size. In the second example shown in FIGS. 6A and 6B, each of the inner wall surface 32 of the guiding portion 30 and the opposed surface 42 of the wall 40 has a circular shape with the identical size. Any of the above structures enjoy an effect that, when the air flow moves from the air-flow passage in the bass reflex port 20 to the air-flow passage between the inner wall surface 32 of the guiding portion 30 and the opposed surface 42 of the wall 40, the cross-sectional areas of the air-flow passages are not discontinuously changed. However, the air flow that flows in from the bass reflex port 20 moves radially in a region between the inner wall surface 32 of the guiding portion 30 and the opposed surface 42 of the wall 40 with an increasing cross-sectional area of the air flow, and then flows out to a space inside the housing 10. In order to decrease a change in cross-sectional area of the air flow when the air flow moves out of the region between the inner wall surface 32 of the guiding portion 30 and the opposed surface 42 of the wall 40 to the space inside the housing 10, it is necessary to sufficiently increase the cross-sectional area of the air flow in the region between the inner wall surface 32 of the guiding portion 30 and the opposed surface 42 of the wall 40. Accordingly, in the first and the second examples, it is necessary that the shortest distance R among distances from the center axis ax of the bass reflex port 20 to respective end portions of the inner wall surface 32 of the guiding portion 30 and the opposed surface 42 of the wall 40 enables the cross-sectional area of the air flow to be sufficiently large.

In the above-described structure, when a vibration plate of the speaker unit SP is vibrated, vibration of a pressure in the inside of the housing 10 is generated by the vibration of the vibration plate. When the inside of the housing 10 is highly pressurized, there is generated an air flow that flows from the inside of the housing 10 to an outside of the housing 10 via the air-flow passage between the inner wall surface 32 of the guiding portion 30 and the opposed surface 42 of the wall 40 and the bass reflex port 20. On the other hand, when the pressure in the housing 10 is lowered, there is generated an air flow that flows from the outside of the housing 10 to the inside of the housing 10 via the bass reflex port 20 and the air-flow passage between the wall 40 and the guiding portion 30. At this time, the bass reflex port 20 and the housing 10 function as a Helmholtz resonator having a resonance frequency in the neighborhood of the lowest frequency in a flat sound pressure band in output characteristics of the bass reflex type speaker 101.

In the above-described bass reflex type speaker 101, in a section from the inside of the bass reflex port 20 to the air-flow passage between the guiding portion 30 and the wall 40, the air flow is guided by the inner wall surface 32 of the guiding portion 30, and the cross-sectional areas of the air-flow passages are not rapidly changed. Accordingly, while the bass reflex port 20 and the housing 10 function as the Helmholtz resonator, the air flow is guided by an inner wall of the bass reflex port 20 and the inner wall surface 32 of the guiding portion 30, so that the air flow is unlikely to be separated. Further, since a large adverse pressure gradient is not generated in an air-flow passage which is constituted by the air-flow passage inside the bass reflex port 20 and the air-flow passage between the guiding portion 30 and the wall 40, extraneous noise due to separation of the air flow can be reduced. In the bass reflex type speaker 101, the air flow that flows from the bass reflex port 20 to the space between the guiding portion 30 and the wall 40 moves radially such that the cross-sectional area of the air flow gradually increases, and flows out to the inside of the housing 10. On the other hand, discharge of the air flow from the inside of the housing to the outside of the housing 10 takes the contrary process. Accordingly, over an entire section of the air-flow passage, separation of the air flow can be prevented and extraneous noise can be reduced.

In the present embodiment, an inner wall surface of the straight portion 22 of the bass reflex port 20 and the inner wall surface 32 of the guiding portion 30 which is opposed to the wall 40 are connected to each other by an inner wall surface of the flare portion 25 which forms a curved surface. No steps are present between the inner wall surface of the straight portion 22 and the inner wall surface of the flare portion 25, and no steps are present between the inner wall surface of the flare portion 25 and the inner wall surface 32 of the guiding portion 30. Thus a region from the inner wall surface of the straight portion 22 of the bass reflex port 20 to the inner wall surface 32 of the guiding portion 30 forms a continuously and smoothly curved surface. Accordingly, in the present embodiment, a cross-sectional area of the air-flow passage enclosed by the inner wall of the bass reflex port 20 continuously increases from a position near the opening inside the bass reflex port 20 that forms a boundary between the straight portion 22 and the flare portion 25 to the guiding portion 30. Therefore, in a process in which the air flow moves from the bass reflex port 20 to the air-flow passage between the guiding portion 30 and the wall 40, it is possible to prevent separation of the air flow from the inner wall of the bass reflex port 20 and reduce extraneous noise.

Figure 7:
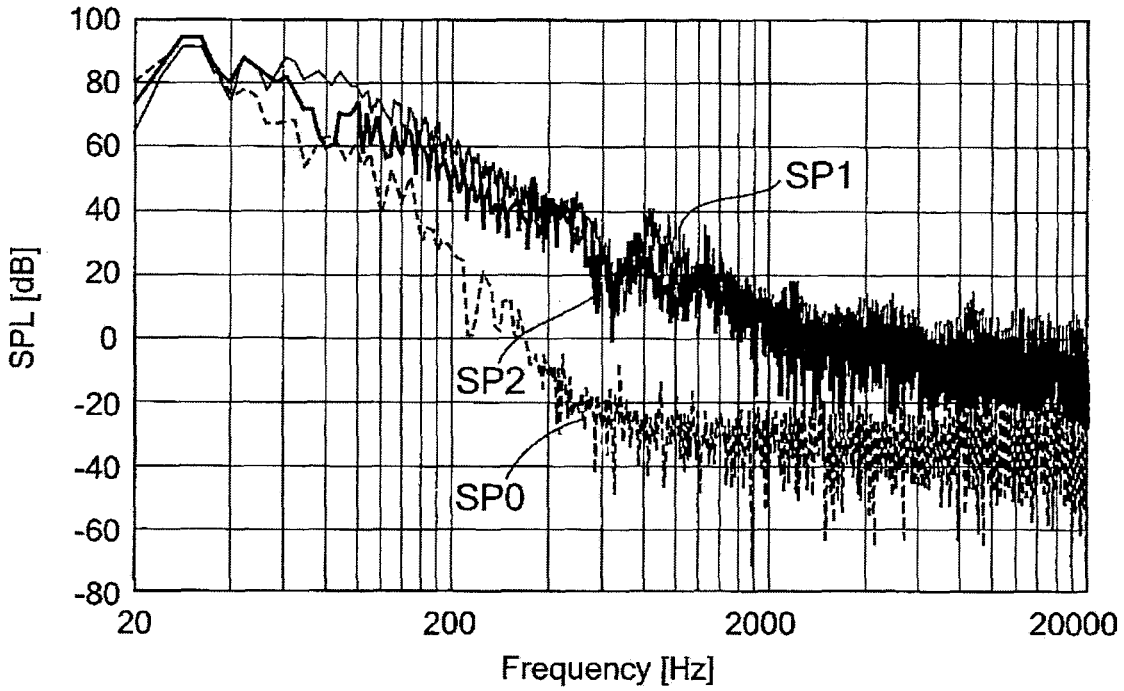
FIG. 7 is a view showing an effect of the first embodiment.

FIG. 7 is a view showing an effect of the present embodiment. In FIG. 7, in a two-dimensional coordinate whose horizontal axis represents frequency and vertical axis represents sound volume, there are shown frequency characteristics SP0 of SPL (Sound Pressure Level) of an input audio signal, frequency characteristics SP1 of SPL outputted by a bass reflex type speaker to the input audio signal as a comparative example, and frequency characteristics SP2 of SPL outputted by the bass reflex type speaker 101 to the input audio signal in the present embodiment.

The bass reflex type speaker as the comparative example is a bass reflex type speaker that comprises a bass reflex port having flare portions at opposite ends thereof, each flare portion having an elliptic cross section. The input audio signal is an audio signal in movie contents. In this example, as the input audio signal to the speaker, there is used, among audio signals in movie contents, a 0.25-second part picked out of signals for reproducing sounds of low pitch in which extraneous noise is likely to become a problem.

As apparent from the frequency characteristics SP0 of the input audio signal shown in FIG. 7, the input audio signal hardly contains a band of several hundred Hz or higher. However, when the input audio signal is supplied to the bass reflex type speaker as the comparative example, SPL of an output sound generated from the bass reflex type speaker as the comparative example exceeds SPL of the input audio signal in a high range. This increase in SPL of the output sound with respect to SPL of the input audio signal is high-range noise (extraneous noise) generated by the bass reflex type speaker as the comparative example.

On the other hand, in the bass reflex type speaker 101 in the present embodiment, an increase in sound pressure level SP2 of an output sound in a high range with respect to sound pressure level SP0 of the input audio signal is smaller than that in the comparative example. That is, in the present embodiment, sound pressure level of extraneous noise is smaller than that in the comparative example. According to the present embodiment described above, extraneous noise can be more effectively reduced than the comparative example.

<Modification of First Embodiment>

Figure 8:
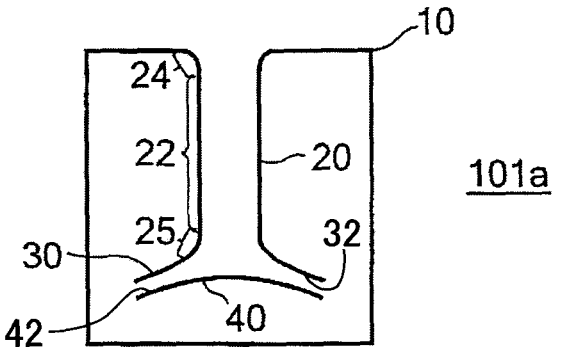
FIG. 8 is a view of a bass reflex type speaker according to a first modification of the first embodiment.
Figure 9:
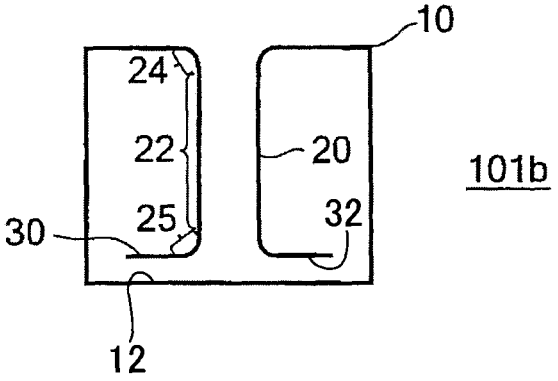
FIG. 9 is a view of a bass reflex type speaker according to a second modification of the first embodiment.
Figure 10:
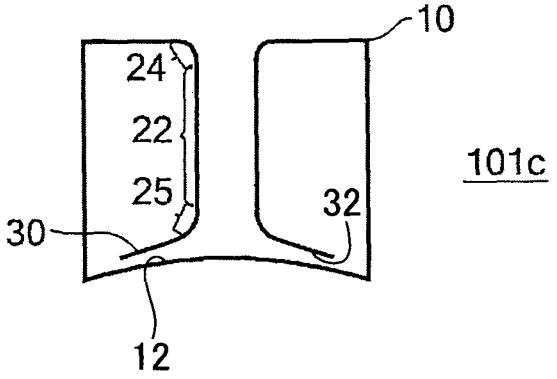
FIG. 10 is a view of a bass reflex type speaker according to a third modification of the first embodiment.

FIG. 8 is a cross-sectional view schematically showing a structure of a bass reflex type speaker 101*a* as according to a first modification of the first embodiment. In FIG. 8 and FIGS. 9 and 10 described later, illustration of the speaker unit SP is omitted, and a cross section of the housing 10, the bass reflex port 20, and so forth are indicated by a solid line. In FIGS. 8 through 10, the same reference numerals as used in FIGS. 1 through 4 are used to identify portions corresponding to those shown in FIGS. 1 through 4, and explanation thereabout will be omitted.

In the first modification, the opposed surface (the inner wall surface) 32 of the guiding portion 30 that is opposed to the wall 40 in the housing 10 is disposed at an angle that is greater than 180 degrees and smaller than 270 degrees with respect to the inner wall of the straight portion 22 of the bass reflex port 20. The opposed surface 42 of the wall 40 in the housing 10 that is opposed to the guiding portion 30 protrudes in a mountain-like manner such that a region thereof opposed to the opening of the bass reflex port 20 becomes an apex. In the cross-sectional view of FIG. 8, the guiding portion 30 extends lineally away from the center axis ax.

As shown in FIG. 8, the opposed surface 42 of the wall 40 may not be a plane, but a curved surface. This modified arrangement also ensures the effect similar to the first embodiment. Further, in this modified arrangement, a radius of curvature at each position of an inner wall from the inner wall of the straight portion 22 to the inner wall surface 32 of the guiding portion 30 via the inner wall of the flare portion 25 is greater than that in the first embodiment, so that separation of the air flow from the inner wall can be effectively prevented.

FIG. 9 is a cross-sectional view schematically showing a structure of a bass reflex type speaker 101*b* according to a second modification of the first embodiment. In the second modification, the wall 40 is not provided, and a wall (a bottom portion of the housing 10) that forms a bottom surface 12 (as one example of an inside housing second surface) of the housing 10 is opposed to the inner wall surface 32 of the guiding portion 30. Thus, the bottom surface 12 has a function similar to the opposed surface 42 of the wall 40 in the first embodiment. In the cross-sectional view of FIG. 9, the guiding portion 30 extends linearly away from the center axis ax. The bottom portion of the housing 10 having the bottom surface 12 can be referred to as a bottom that constitutes an outline of the housing 10. The second modification also ensures the effect similar to the first embodiment. Further, according to the second modification, the wall 40 in the first embodiment is unnecessary, enabling the bass reflex type speaker 101*b* to be inexpensive. Furthermore, according to the second modification, since the bottom surface 12 of the housing 10 is disposed closer to the flare portion 25 of the bass reflex port 20, the housing 10 is downsized as compared with the first embodiment. In an instance where one of opposite opening ends of the bass reflex port 20 closer to the outside of the housing 10 is formed in a wall that constitutes a side surface of the housing 10 and the bass reflex port 20 is disposed in the housing 10 such that the center axis ax of the bass reflex port 20 extends horizontally, an inner wall surface of the side surface of the housing 10 may be an opposed surface that is opposed to the inner wall surface 32 of the guiding portion 30. In this arrangement, the wall 40 in the first embodiment is not necessary, so that the bass reflex port 20 can be inexpensively produced.

FIG. 10 is a cross-sectional view schematically showing a structure of a bass reflex type speaker 101*c* according to a third modification of the first embodiment. The third modification is a combination of the first modification and the second modification. Similarly to the second modification, in the third modification, the wall 40 is not provided, and the wall (the bottom portion of the housing 10) that forms the bottom surface 12 of the housing 10 has a function similar to the opposed surface 42 of the wall 40. In the third modification, the opposed surface (the inner wall surface) 32 of the guiding portion 30 that is opposed to the wall of the housing 10 is disposed at an angle that is greater than 180 degrees and smaller than 270 degrees with respect to the inner wall of the straight portion 22 of the bass reflex port 20. The wall having the bottom surface 12 of the housing 10 that is opposed to the inner wall surface 32 of the guiding portion 30 protrudes in a mountain-like manner such that a region thereof opposed to the opening of the bass reflex port 20 becomes an apex. In the cross-sectional view of FIG. 10, the guiding portion 30 extends lineally away from the center axis ax.

The third modification also ensures the effect similar to the first embodiment. Further, in this modified arrangement, a radius of curvature at each position of an inner wall from the inner wall of the straight portion 22 to the inner wall surface 32 of the guiding portion 30 via the inner wall of the flare portion 25 is greater than that in the first embodiment, so that separation of the air flow from the inner wall can be effectively prevented. Furthermore, according to the arrangement, the wall 40 in the first embodiment is unnecessary, enabling the bass reflex type speaker 101*c* to be inexpensive. In the third modification, since the bottom surface 12 of the housing 10 is disposed closer to the flare portion 25 of the bass reflex port 20, the housing 10 is downsized as compared with the first embodiment.

Second Embodiment

Figure 11:
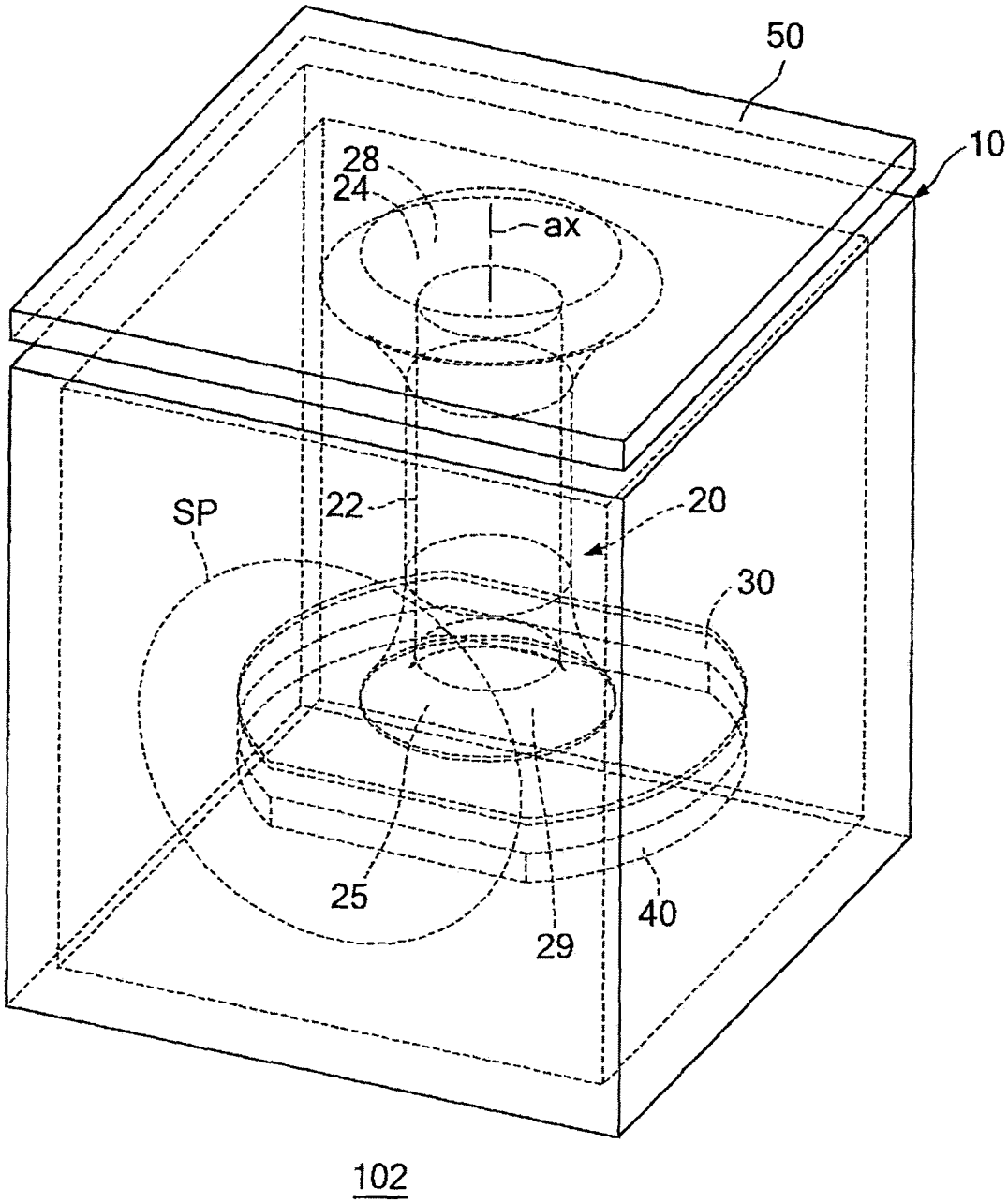
FIG. 11 is a perspective view of a bass reflex type speaker according to a second embodiment, the view seen from an obliquely upper side.
Figure 12:
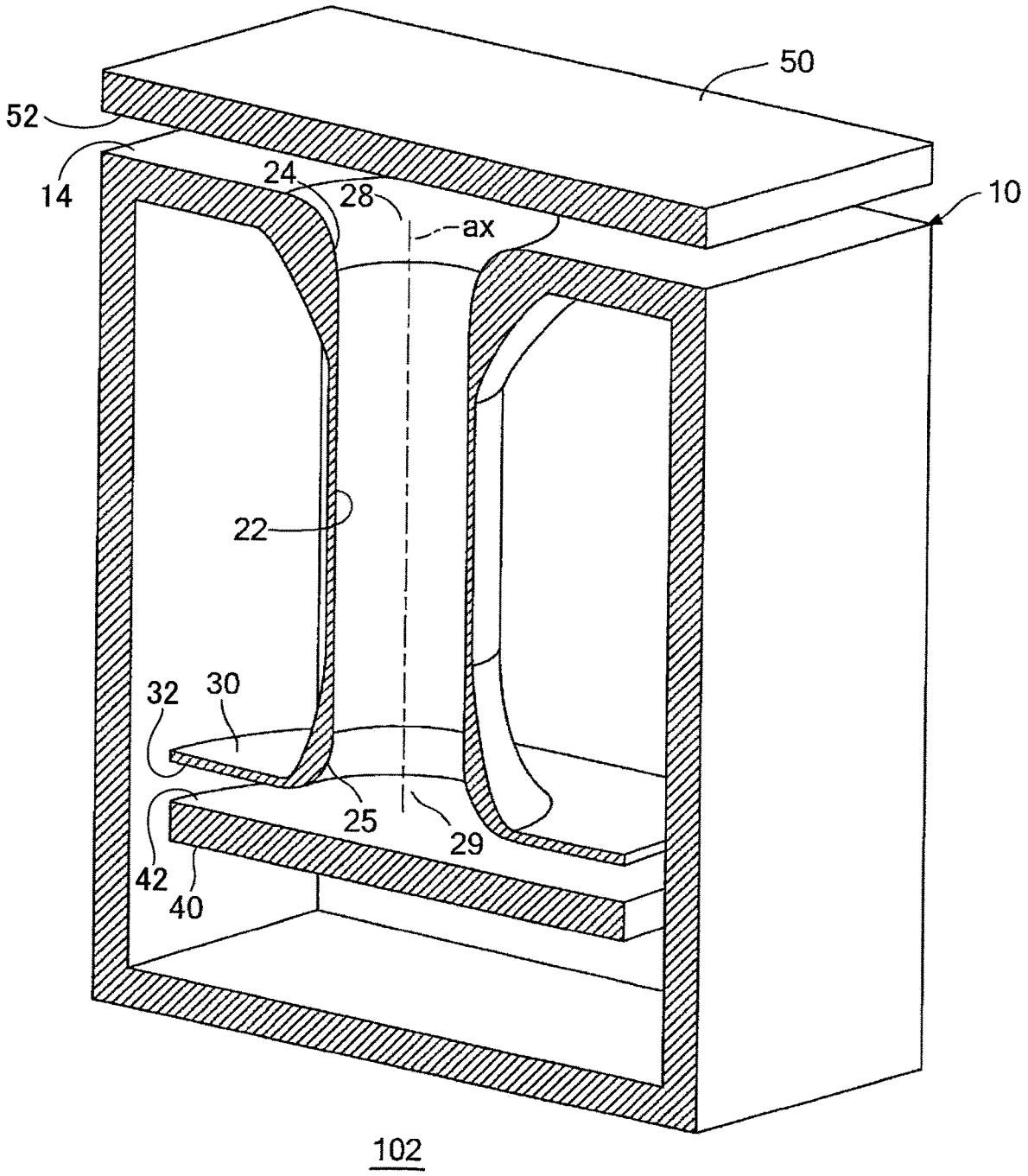
FIG. 12 is a cross-sectional view of a structure of the bass reflex type speaker when the bass reflex type speaker is cut on a plane including a center axis of a bass reflex port and parallel to a surface of a housing on which a speaker unit is disposed.
Figure 13:
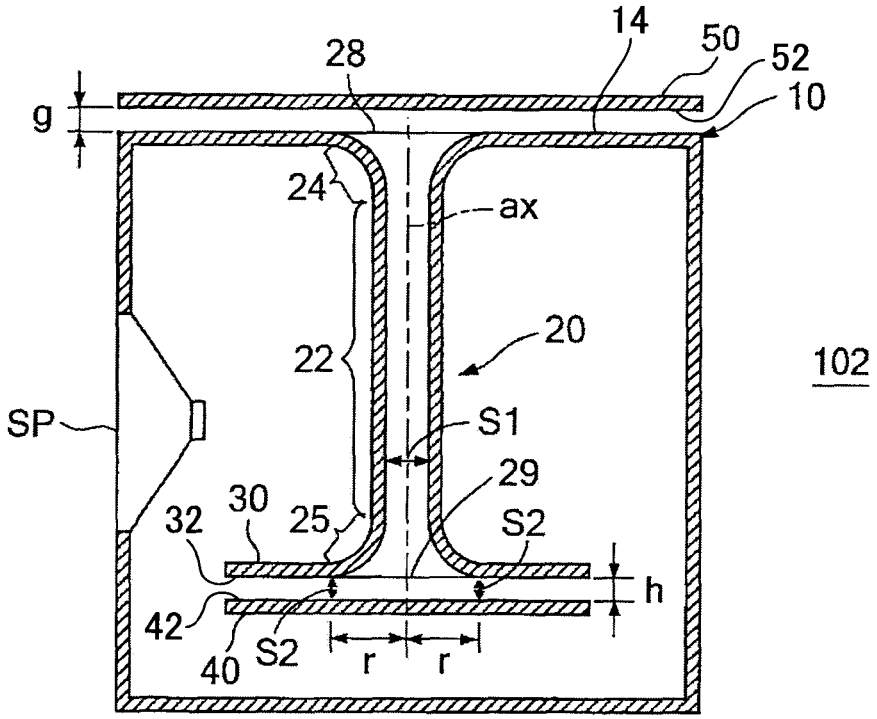
FIG. 13 is a cross-sectional front view schematically showing a structure of the bass reflex type speaker.

FIG. 11 is a perspective view of a bass reflex type speaker 102, seen from an obliquely upper side, according to a second embodiment. FIG. 12 is a cross-sectional view showing a structure of the bass reflex type speaker 102 when the bass reflex type speaker 102 is cut on a plane including a center axis ax of the bass reflex port 20 and parallel to a surface of the housing 10 on which the speaker unit SP is disposed. FIG. 13 is a cross-sectional front view schematically showing a cross-sectional structure of the bass reflex type speaker 102. In FIGS. 11 through 13, the same reference numerals as used in FIGS. 1, 3, and 4 are used to identify portions corresponding to those shown in FIGS. 1, 3, and 4, and explanation thereabout will be omitted.

In the bass reflex type speaker 102 according to the present embodiment, a wall 50 (as one example of an outside housing surface forming portion) is additionally provided to the structure of the bass reflex type speaker 101 in the first embodiment. An opposed surface 52 of the wall 50 is opposed to an upper surface 14 of the housing 10 with a distance g therebetween. In the present embodiment, while a space inside the bass reflex port 20 is connected to a space inside the housing 10 via the air-flow passage between the guiding portion 30 and the wall 40 as in the first embodiment, the space inside the bass reflex port 20 is connected to a space outside the housing 10 (more precisely, a space that is located outside the housing 10 and is not located between the wall 50 and the housing 10). In the cross-sectional view of FIG. 13, the guiding portion 30 extends linearly away from the center axis ax.

In the present embodiment, in an instance where a radius of the opening end (an opening circular region) 28 of the flare portion 24 is identical with a radius of the opening end (an opening circular region) 29 of the flare portion 25, the distance g may coincide with the distance h between the guiding portion 30 and the wall 40. In an instance where the radius of the opening end (the opening circular region) 28 of the flare portion 24 and the radius of the opening end (the opening circular region) 29 of the flare portion 25 differ from each other, the distance g may be calculated in the same manner as that in which the distance h is calculated in the first embodiment. In other words, where the radius of the opening circular region of the flare portion 24 is r0, the distance g is set to be r0/2, for example.

In the above structure, a cross-sectional area of an air-flow passage between the upper surface 14 of the housing 10 and the opposed surface 52 of the wall 50 at the opening end 28 is equal to (or close to) the cross-sectional area of the opening end 28 of the flare portion 24, so that, in a section of an air-flow passage that is constituted by a section inside the bass reflex port 20 and a section between the housing 10 and the wall 50, a discontinuous change in the cross-sectional area of the air-flow passage can be prevented.

In the present embodiment, both of air turbulence in the opening of the bass reflex port 20 in the inside of the housing 10 and air turbulence in the opening thereof communicating with the outside of the housing 10 can be prevented, so that extraneous noise can be more effectively reduced than in the first embodiment.

Figure 14:
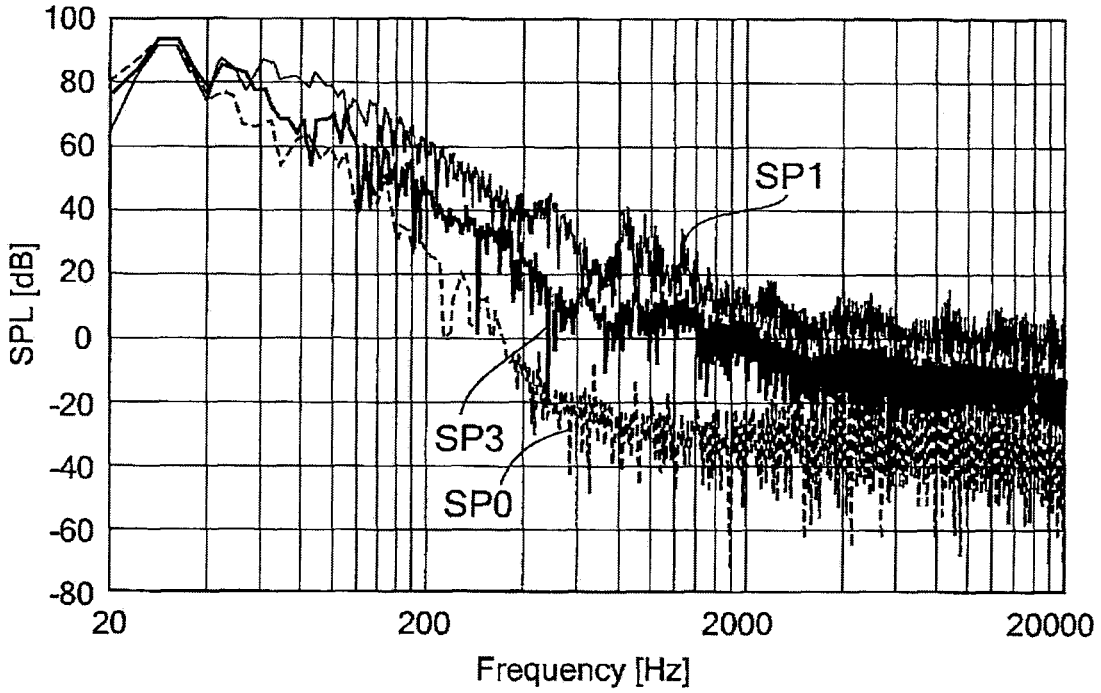
FIG. 14 is a view showing an effect of the second embodiment.

FIG. 14 shows an effect of the present embodiment. In FIG. 14, similarly to the first embodiment (shown in FIG. 7), there are shown frequency characteristics SP0 of SPL of an input audio signal, frequency characteristics SP1 of SPL outputted by a bass reflex type speaker to the input audio signal as a comparative example, and frequency characteristics SP3 of SPL outputted by the bass reflex type speaker 102 to the input audio signal in the present embodiment. As apparent from comparison with FIG. 14 and FIG. 7, sound pressure level SP3 in a high range received from the bass reflex type speaker 102 of the present embodiment is lower than sound pressure level SP2 in a high range received from the bass reflex type speaker 101 of the first embodiment. That is, the present embodiment enables extraneous noise to be reduced more effectively than in the first embodiment.

<Modification of Second Embodiment>

Figure 15:
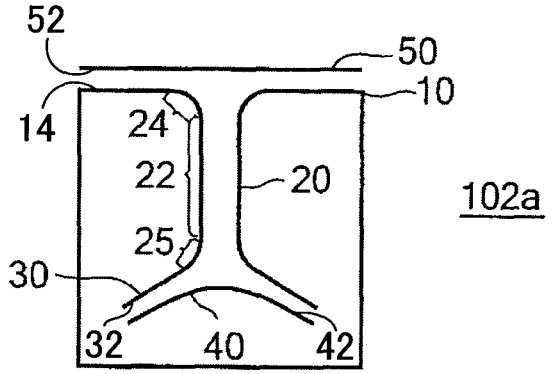
FIG. 15 is a view of a bass reflex type speaker according to a first modification of the second embodiment.

FIG. 15 is a cross-sectional view schematically showing a structure of a bass reflex type speaker 102*a* according to a first modification of the second embodiment. In FIG. 15 and FIGS. 16 through 18 described later, illustration of the speaker unit SP is omitted, and a cross section of the housing 10, the bass reflex port 20 and so forth are indicated by a solid line. In FIGS. 15 through 18, the same reference numerals as used in FIGS. 1, 3, and 4 and FIGS. 11 through 13 are used to identify portions corresponding to those shown in FIGS. 1, 3, and 4 and FIGS. 11 through 13, and explanation thereabout will be omitted.

In the first modification, similarly to the first modification of the first embodiment, the opposed surface (the inner wall surface) 32 of the guiding portion 30 that is opposed to the opposed surface 42 of the wall 40 in the housing 10 is disposed at an angle that is greater than 180 degrees and smaller than 270 degrees with respect to the inner wall of the straight portion 22 of the bass reflex port 20. The wall 40 in the housing 10 that is opposed to the guiding portion 30 protrudes in a mountain-like manner such that a region thereof opposed to the opening of the bass reflex port 20 becomes an apex. Other aspects of the bass reflex type speaker 102*a* are similar to those in the second embodiment. In the cross-sectional view of FIG. 15, the guiding portion 30 extends lineally away from the center axis ax.

This modified arrangement also ensures the effect similar to the second embodiment. Further, in the modified arrangement, a radius of curvature at each position of an inner wall from the inner wall of the straight portion 22 to the inner wall surface 32 of the guiding portion 30 via the inner wall of the flare portion 25 is greater than that in the second embodiment, so that separation of the air flow from the inner wall can be effectively prevented.

Figure 16:
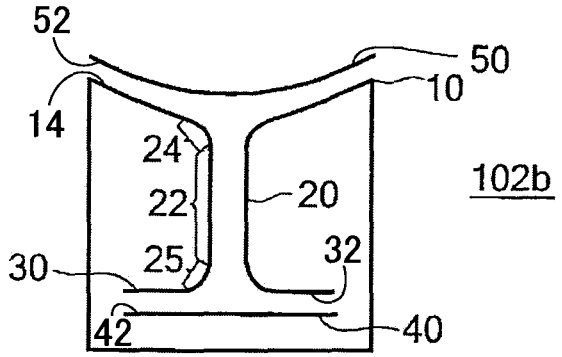
FIG. 16 is a view of a bass reflex type speaker according to a second modification of the second embodiment.

FIG. 16 is a cross-sectional view schematically showing a structure of a bass reflex type speaker 102*b* according to a second modification of the second embodiment. In the second modification, the upper surface 14 that forms an opposed surface of a wall of the housing 10 having an upper surface and that is opposed to the opposed surface 52 of the wall 50 is disposed at an angle that is greater than 180 degrees and smaller than 270 degrees with respect to the inner wall of the straight portion 22 of the bass reflex port 20. Further, the wall 50 protrudes in a mountain-like manner such that a region thereof opposed to the opening of the bass reflex port 20 becomes an apex. Other aspects of the bass reflex type speaker 102*b* are similar to those in the second embodiment. In the cross-sectional view of FIG. 16, the guiding portion 30 extends lineally away from the center axis ax.

This modified arrangement also ensures the effect similar to the second embodiment. Further, in the modified arrangement, a radius of curvature at each position from the inner wall of the straight portion 22 to the upper surface 14 of the housing 10 via the inner wall of the flare portion 24 is greater than that in the second embodiment, so that separation of the air flow from the inner wall of the air-flow passage can be effectively prevented.

Figure 17:
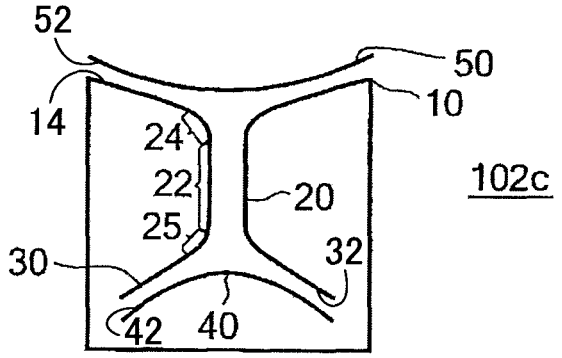
FIG. 17 is a view of a bass reflex type speaker according to a third modification of the second embodiment.

FIG. 17 is a cross-sectional view schematically showing a structure of a bass reflex type speaker 102*c* according to a third modification of the second embodiment. The third modification is a combination of the first modification and the second modification. In the cross-sectional view of FIG. 17, the guiding portion 30 extends lineally away from the center axis ax.

This modified arrangement also ensures the effect similar to the second embodiment. Further, in the modified arrangement, a radius of curvature at each position of the inner wall from the inner wall of the straight portion 22 to the inner wall surface 32 of the guiding portion 30 via the inner wall of the flare portion 25 is greater than that in the second embodiment. Furthermore, similarly to the second modification, a radius of curvature at each position from the inner wall of the straight portion 22 to the upper surface 14 of the housing 10 via the inner wall of the flare portion 24 is greater than that in the second embodiment. Accordingly, separation of the air flow from the inner wall of the air-flow passage can be effectively prevented.

Figure 18:
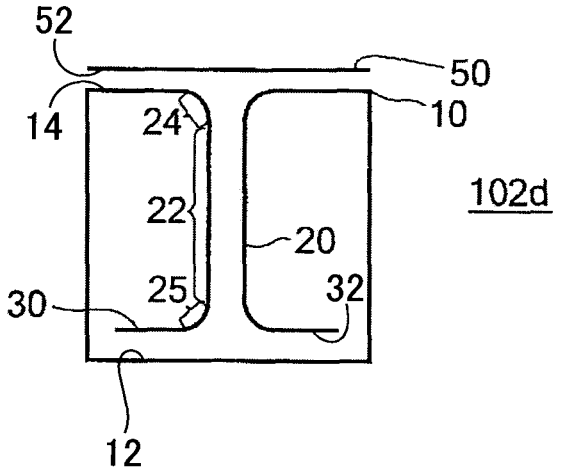
FIG. 18 is a view of a bass reflex type speaker according to a fourth modification of the second embodiment.

FIG. 18 is a cross-sectional view schematically showing a structure of a bass reflex type speaker 102*d* according to a fourth modification of the second embodiment. In the fourth modification, the same modification as applied to the second modification of the first embodiment is applied to the second embodiment. In other words, in the fourth modification, the wall 40 is not provided in the housing 10, and a wall (a bottom wall) that forms the bottom surface 12 of the housing 10 has a function similar to the wall 40. In the cross-sectional view of FIG. 18, the guiding portion 30 extends lineally away from the center axis ax.

According to thus modified arrangement, the wall 40 is unnecessary, enabling the bass reflex type speaker 102*d* to be inexpensive. Further, in the arrangement, since the bottom surface 12 of the housing 10 is disposed closer to the flare portion 25 of the bass reflex port 20, the housing 10 is downsized as compared with the second embodiment.

Although not illustrated, the same modifications as in the first through the third modifications of the second embodiment may be applied to the fourth modification.

OTHER EMBODIMENTS

While there have been explained embodiments of the present disclosure, it is to be understood that the disclosure may be embodied otherwise. Other embodiments will be explained below.

(1) In the illustrated embodiments, the bass reflex port is attached to the upper surface of the housing. The bass reflex port may be attached to either one of an upper surface, a lower surface, a left-side surface, a right-side surface, a front surface, and a rear surface.

(2) The housing, the bass reflex port and the guiding portion may be integrally formed or may be separately produced and then connected to each other. Further, the bass reflex port and the guiding portion may be integrally formed. In the illustrated embodiments, the bass reflex port is formed as the tubular body portion, and the guiding portion is added to the bass reflex port. A structure in which the guiding portion is added to the bass reflex port as the tubular body portion may be employed as a bass reflex port.

(3) In the first embodiment, the distance h between the guiding portion 30 and the wall 40 may be constant, or may be increased in a direction away from the center axis ax of the bass reflex port 20. In this arrangement, a gradient in which a cross-sectional area of the air-flow passage between the guiding portion 30 and the wall 40 increases in the direction away from the center axis ax of the bass reflex port 20 can become large. Accordingly, even in a situation in which respective areas of the guiding portion 30 and the wall 40 cannot be increased, a cross-sectional area of the air flow flowing between the guiding portion 30 and the wall 40 can be increased to permit the air to flow out to the inside of the housing 10, enabling extraneous noise to be reduced.

(4) In the illustrated embodiments, portions of the bass reflex port 20 except the opening (the inlet and outlet)

thereof are disposed so as to be spaced apart from the walls of the housing 10. A part of a side surface of the bass reflex port 20 from one opening to the other opening may be fixed to a wall of the housing 10. A wall of the housing 10 may form a part of the side surface of the bass reflex port 20. In those arrangements, there may be disposed the guiding portion 30 having a shape extending radially outwardly from a section except a section fixed to the wall of the housing among sections over an entire circumference of the opening of the bass reflex port 20.

(5) A length of the guiding portion 30 (or the wall 40) in a direction extending toward the inner wall of the housing may be within a range by reaching the inner wall of the housing. Further, a part of the outer circumference of the guiding portion 30 (or the wall 40) extending radially from the opening of the bass reflex port 20 may reach the inner wall of the housing. However, the guiding portion 30 is constructed such that at least a part of the outer circumference of the guiding portion 30 (or the wall 40) does not reach the inner wall of the housing and does not contact the inner wall of the housing. That is, it is required that the guiding portion 30 and the wall 40 do not divide a space in the housing.

(6) The wall 40 may not be identical with the guiding portion 30 in size or planar shape. The wall 40 may have a size and a planar shape that enable the opening end 29 to be covered.

(7) A part of the bass reflex port 20 may be disposed outside the housing 10.

(8) While the present disclosure is embodied as the bass reflex type speaker disclosed in the illustrated embodiments, the present disclosure may be embodied as a bass reflex port in which the bass reflex port 20 (i.e., the tubular body portion) in the illustrated embodiments and the guiding portion 30 are integrally formed or as a bass reflex port in which the bass reflex port 20 (i.e., the tubular body portion), the guiding portion 30, and the wall 40 are integrally formed.

(9) In the first embodiment, in addition to the first measure, the second measure is also employed. Where a desired effect for preventing generation of extraneous noise is ensured only by the first measure, only the first measure may be employed. This is true of the other embodiments. In other words, similarly to the first structure of the first embodiment illustrated in FIG. 2, a structure in which the wall 40 is not disposed may be applied to respective structures shown in FIGS. 8, 11, 12, 13, 15, 16 and 17 to provide a structure in which the wall 40 is not disposed.

What is claimed is:

1. A bass reflex type speaker comprising a bass reflex port including:

a housing of the speaker;

a tubular body portion; and a surface forming portion which is continuous to an inner wall of the tubular body portion and which has a surface extending radially outwardly from an opening end of the tubular body portion disposed in the housing of the speaker, wherein the surface forming portion extends linearly in a direction away from a tube axis of the tubular body portion in a cross section parallel to the tube axis, wherein the surface forming portion is an inside housing first surface forming portion and has an inside housing first surface disposed in the housing, wherein the bass reflex port type speaker further comprises an inside housing second surface forming portion disposed in the housing at a first position remote from a wall surface of the housing or at a second position remote from a bottom surface of the housing and having an inside housing second surface, and wherein the inside housing first surface and the inside housing second surface are parallel to each other.

2. The bass reflex type speaker according to claim 1, wherein a cross-sectional area of an air-flow passage via the bass reflex port continuously increases radially outwardly from the opening end in the bass reflex port.

3. The bass reflex type speaker according to claim 1, wherein, in an instance where a cross section of an air-flow passage at the opening end of the tubular body portion in the housing in a direction perpendicular to the tube axis of the tubular body portion has a circular shape with a radius r0, a distance between the inside housing first surface and the inside housing second surface is r0/2.

4. The bass reflex type speaker according to claim 1, wherein the tubular body portion has a straight portion whose perpendicular cross-sectional area is constant in a direction of the tube axis and a flare portion whose perpendicular cross-sectional area increases from a boundary at the straight portion toward the opening end, the perpendicular cross-sectional area being an area of a cross section of an air-flow passage in a direction perpendicular to the tube axis, and wherein a cross-sectional area of the air-flow passage between the inside housing first surface and the inside housing second surface at the opening end of the flare portion is greater than or equal to about one time the perpendicular cross-sectional area of the straight portion and smaller than or equal to about 2.5 times the perpendicular cross-sectional area of the opening end of the flare portion.

5. The bass reflex type speaker according to claim 1, wherein the inside housing first surface of the surface forming portion is disposed at an angle that is greater than 180 degrees and smaller than 270 degrees with respect to the inner wall of the bass reflex port, and wherein the inside housing second surface protrudes such that a region thereof opposed to the opening end in the bass reflex port becomes an apex.

6. The bass reflex type speaker according to claim 1, wherein the inside housing second surface is a surface of a wall or a surface of a bottom that constitutes an outline of the housing.

7. The bass reflex type speaker according to claim 1, wherein the inside housing second surface is a surface except respective surfaces of a wall and a bottom that constitute an outline of the housing.

8. The bass reflex type speaker according to claim 1, comprising an outside housing surface forming portion having a surface opposed to an opening end of the bass reflex port that is closer to an outside of the housing.

* * * * *